US010292535B2

(12) United States Patent
Clewell

(10) Patent No.: US 10,292,535 B2
(45) Date of Patent: May 21, 2019

(54) BATHTUB EXTENSION LINER

(71) Applicant: Linda Jeanne Clewell, Flagstaff, AZ (US)

(72) Inventor: Linda Jeanne Clewell, Flagstaff, AZ (US)

(73) Assignee: Linda Jeanne Clewell, Flagstaff, AZ (US)

( * ) Notice: Subject to any disclaimer, the term of this patent is extended or adjusted under 35 U.S.C. 154(b) by 0 days.

(21) Appl. No.: 15/689,003

(22) Filed: Aug. 29, 2017

(65) Prior Publication Data

US 2019/0059657 A1 Feb. 28, 2019

(51) Int. Cl.
*A47K 3/02* (2006.01)
*A47K 3/00* (2006.01)

(52) U.S. Cl.
CPC ..... *A47K 3/001* (2013.01)

(58) Field of Classification Search
CPC ..... A47K 3/001
USPC ..... 4/580
See application file for complete search history.

(56) References Cited

U.S. PATENT DOCUMENTS 3,931,652 A * 1/1976 Navarra ..... A47K 3/064 4/580
5,345,622 A * 9/1994 Plone ..... A47K 3/06 4/585
5,839,132 A * 11/1998 Rooney ..... A47K 3/002 4/583
6,336,231 B1 * 1/2002 Smith ..... A47K 3/001 4/573.1

* cited by examiner

*Primary Examiner* — Huyen Le
(74) *Attorney, Agent, or Firm* — Invention Mine LLC

(57) ABSTRACT

A bathtub extension liner includes, but is not limited to a plurality of horizontally inflatable tubes adapted to be positioned around an outer perimeter of a bathtub; a vinyl assembly connected to the plurality of horizontally inflatable tubes, the vinyl assembly adapted to line an interior area of a bathtub; and a drain assembly, said drain assembly centrally positioned within the vinyl assembly adapted to line the interior area of the bathtub near an end of a lengthwise dimension of the vinyl assembly wherein water that is held inside the inflatable bathtub liner is released through the drain assembly and exits through a conventional bathtub drain as provided on the conventional bathtub.

20 Claims, 4 Drawing Sheets

BATHTUB EXTENSION LINER

FIELD OF INVENTION

This invention relates generally to the field of bathtub extensions and methods for extending a bathtub.

SUMMARY

According to an embodiment, an inflatable bathtub liner includes a plurality of horizontally inflatable tubes adapted to be positioned around an outer perimeter of a bathtub; a vinyl assembly connected to the plurality of horizontally inflatable tubes, the vinyl assembly adapted to line an interior area of a bathtub; and a drain assembly, said drain assembly centrally positioned within the vinyl assembly adapted to line the interior area of the bathtub near the end of a lengthwise dimension of the vinyl assembly wherein water that is held inside the inflatable bathtub liner is released through the drain assembly and exits through a conventional tub drain as provided on the conventional bathtub.

In one embodiment, the inflatable bathtub liner includes a plurality of horizontally spaced attachments coupled to one or more of the plurality of horizontally inflatable tubes for securing the inflatable bathtub liner to the interior area of the bathtub. The plurality of horizontally spaced attachment can include suction cups disposed on one or more of the plurality of horizontally inflatable tubes or on a side of the vinyl assembly.

In one embodiment, the plurality of horizontally inflatable tubes are organized into two or more separately fillable sections along each side of the inflatable bathtub liner that can remain unfilled as a function of location of the bathtub liner with respect to a wall.

Another embodiment is directed to a method for extending a bathtub including releasably attaching a bathtub extension liner to the bathtub, the bathtub extension liner including a plurality of horizontally inflatable tubes defining an outer perimeter of a bathtub; lining an interior area of the bathtub with a vinyl assembly portion of the bathtub extions liner, the vinyl assembly connected to the plurality of horizontally inflatable tubes; closing a drain assembly centrally positioned within the vinyl assembly near the end of a lengthwise dimension of the vinyl assembly; and filling one or more of the plurality of horizontally inflatable tubes to extend a vertical dimension of the bathtub.

In one embodiment, filling one or more of the plurality of horizontally inflatable tubes to extend a vertical dimension of the bathtub includes filling one or more of four quadrants defining the plurality of horizontally inflatable tubes, each quadrant defining a side of the bathtub, wherein each quadrant along a wall remains unfilled.

In one or more various aspects, related article of manufacture are configured to effect the herein-referenced aspects depending upon the design choices of the system designer. In addition to the foregoing, other method aspects are described in the claims, drawings, and text forming a part of the present disclosure.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
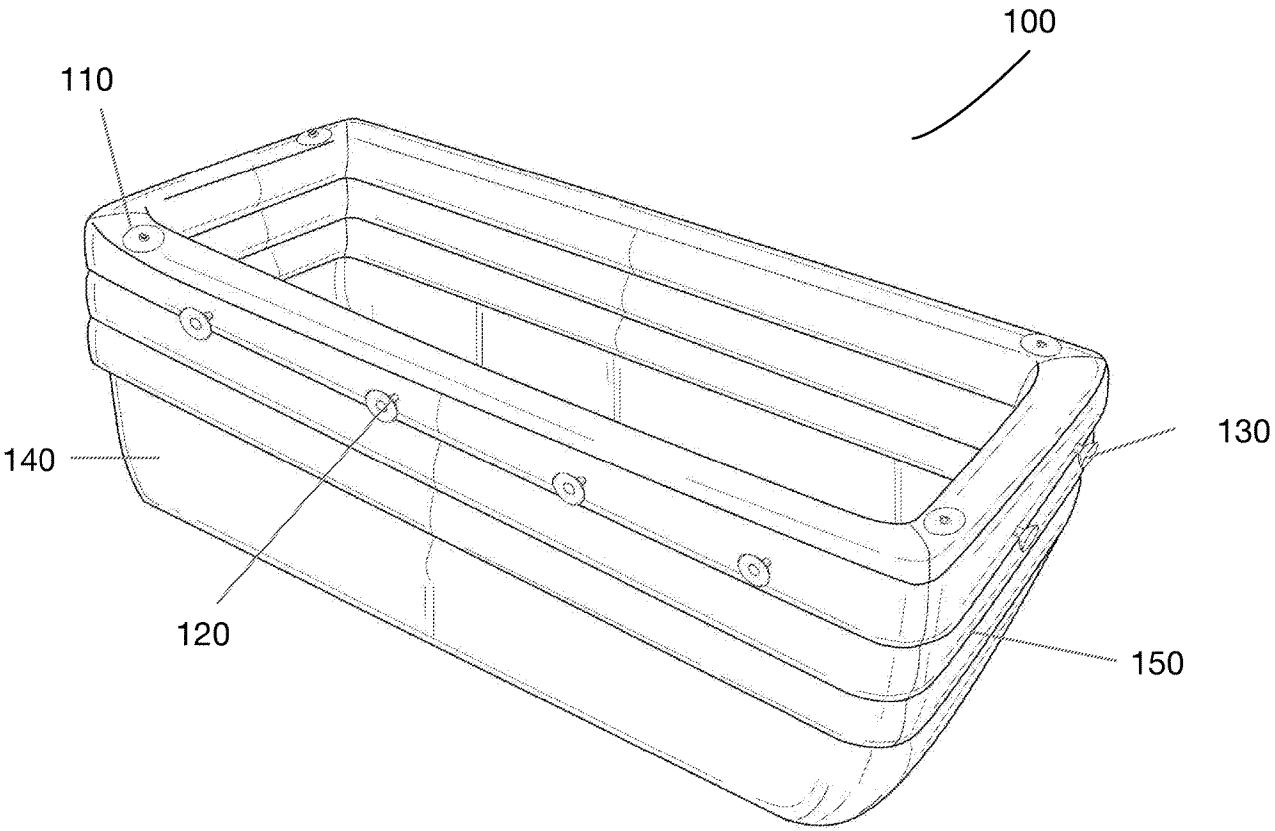
FIG. 1 shows an isometric view of an exemplary bathtub extension liner in accordance with the present application.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

Referring now to FIG. 1, the figure illustrates an isometric view of a bathtub extension liner in accordance with an embodiment. As shown, inflatable bathtub liner 100 includes a plurality of horizontally inflatable tubes 150 adapted to be positioned around an outer perimeter of a bathtub. Inflatable bathtub liner 100 includes a vinyl assembly 140 connected to the plurality of horizontally inflatable tubes 150 so that the vinyl assembly can line an interior area of a bathtub. Vinyl assembly 140 and the plurality of horizontally inflatable tubes 150 can be implemented using between 10 and 16 gauge vinyl.

Also shown in FIG. 1 are releasable attachments 130 about the perimeter of inflatable bathtub liner 100, which can be implemented as suction cups. In one embodiment, inflatable bathtub liner includes a plurality of intake/exhaust valves 110 coupled to each of four air chambers, distributed as separately fillable quadrants. All quadrants can be filled or some quadrants abutting a wall can be left unfilled with the attachments securing the unfilled quadrant against a wall, depending on user requirements.

Figure 2:
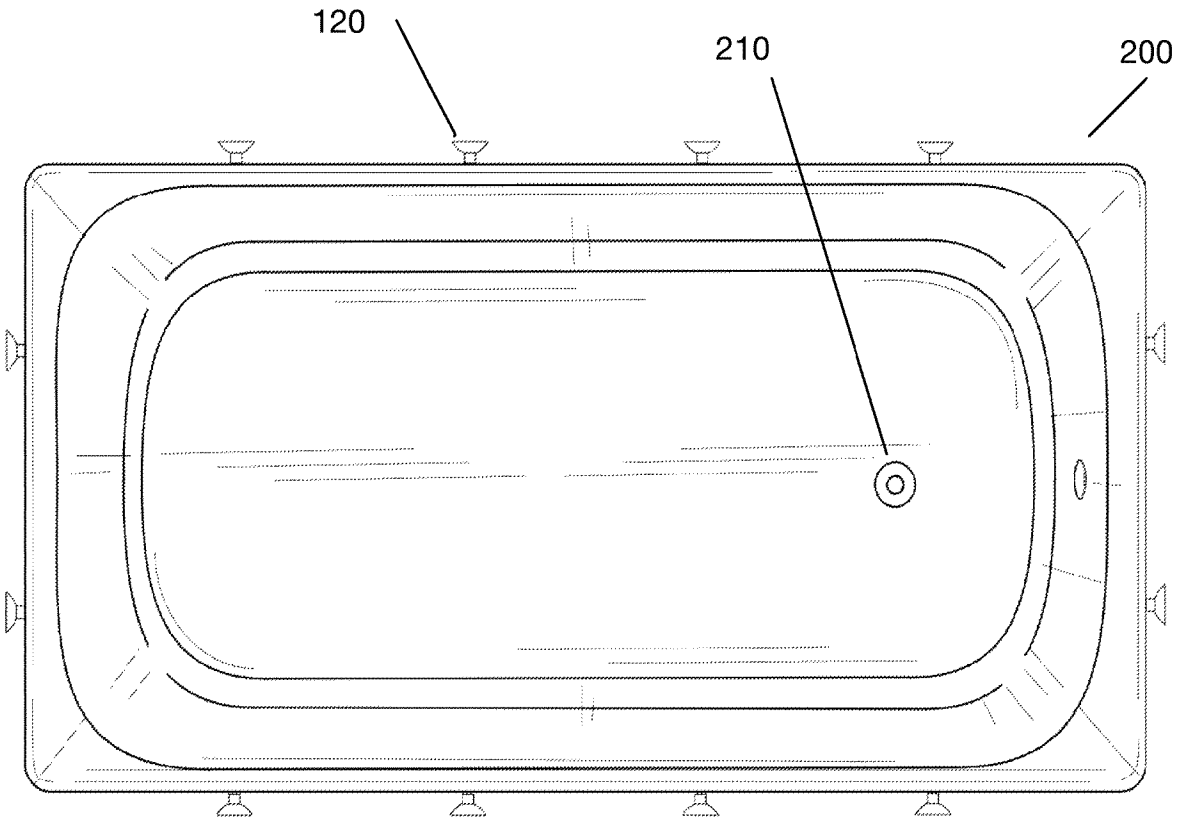
FIG. 2 shows another view of the bathtub extension liner in accordance with the present application.

Referring to FIG. 2, a top view of the inflatable bathtub liner illustrates attachments 120 and drain assembly 210. Drain assembly 210, as shown, can be centrally positioned within the vinyl assembly near the end of a lengthwise dimension of the vinyl assembly, such as where a drain of a bathtub would be located to enable colocation of the drain assembly with a typical bathtub drain. In an embodiment, water that is held inside the inflatable bathtub liner can be released through the drain assembly and exit through a conventional bathtub drain.

Figure 3:
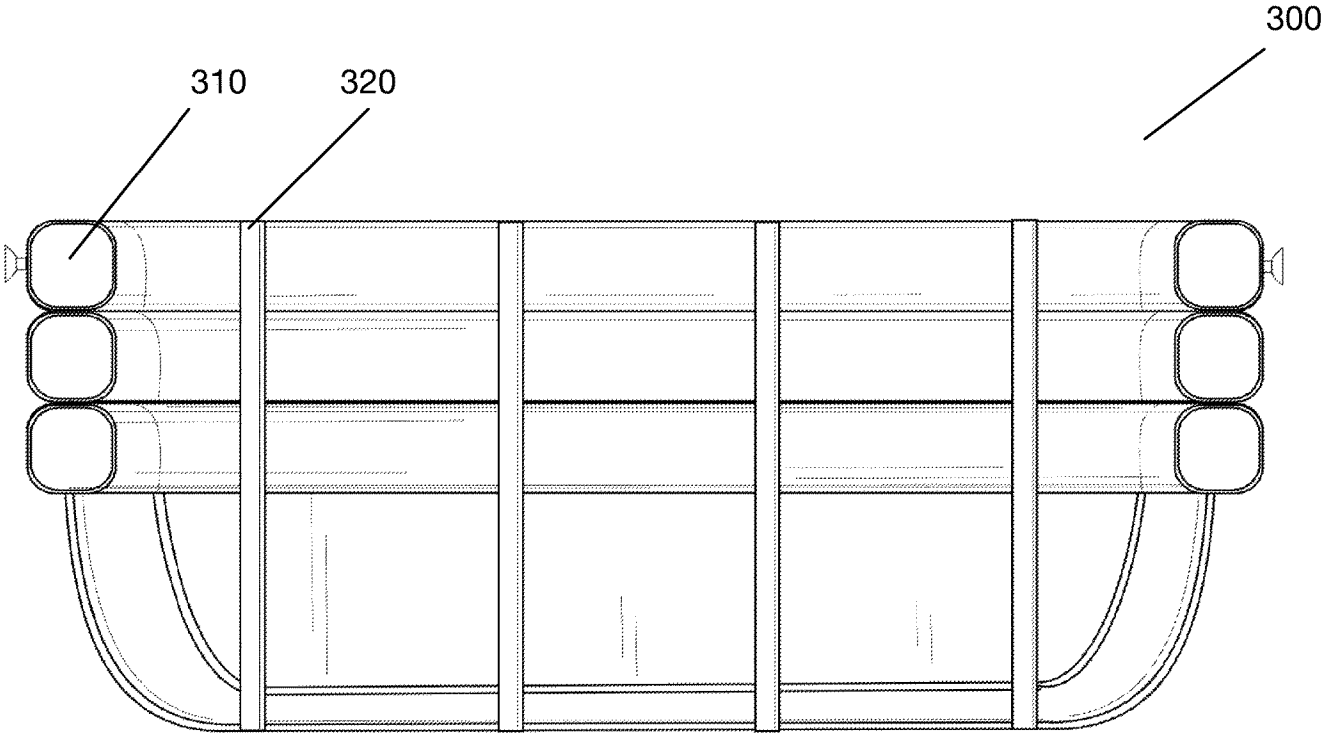
FIG. 3 shows another view of the bathtub extension liner in accordance with the present application.

Referring now to FIG. 3, an embodiment of the inflatable bathtub liner 300 is shown wherein the plurality of horizontally inflatable tubes 310 are shown as separately inflatable, one from another. In other embodiments, the horizontally inflatable tubes 310 are joined as separately inflatable quadrants, each quadrant defining a side of the inflatable bathtub liner 300. FIG. 3 further shows optional vertical support 320 configured to provide vertical support for inflatable bathtub liner 300 in some embodiment. Vertical supports 320, as illustrated, can be implemented as providing four supports for each longitudinal side of the inflatable bathtub liner 300. In other embodiments, fewer supports may be required. In one embodiment, the inflatable bathtub liner 300 includes a plurality of vertical sleeves for receiving vertical supports 320 along a longitudinal dimension of the inflatable bathtub liner, each of the plurality of vertical sleeves adapted to receive a stiffened member for providing vertical stability to the inflatable bathtub liner. Vertical supports 320 can be implemented as thicker vinyl gauged sections instead of sleeves or can be implemented as sleeves with plastic inserts to enable removal as necessary.

Figure 4:
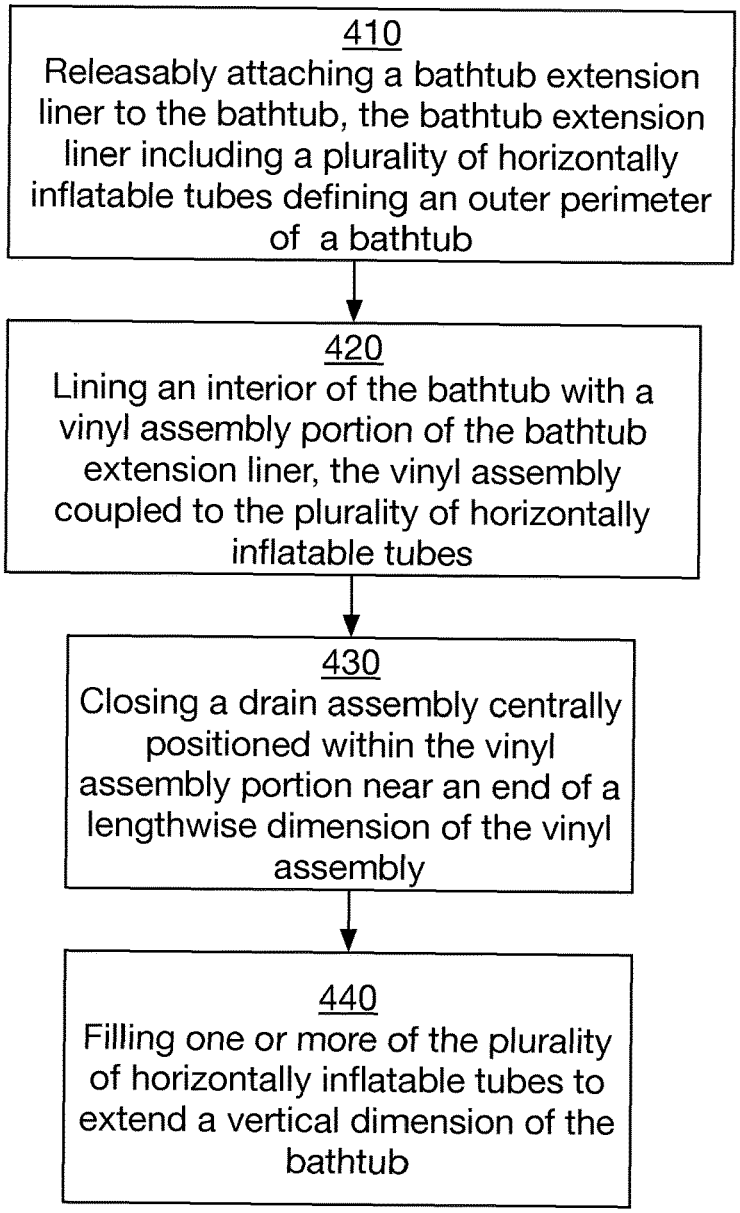
FIG. 4 is a flow diagram illustrating a method in accordance with an embodiment of the present application.

Referring now to FIG. 4, a flow diagram illustrates a method in accordance with an embodiment. More specifically, a method for extending a bathtub includes as shown in step 410 as releasably attaching a bathtub extension liner to the bathtub, the bathtub extension liner including a plurality of horizontally inflatable tubes defining an outer perimeter of a bathtub. For example, as shown in FIG. 1, horizontally inflatable tubes can include three layers of horizontally inflatable tubes separately inflatable through air chamber quadrants, each defining a side of a bathtub.

Step 420 provides for lining an interior area of the bathtub with a vinyl assembly portion of the bathtub extension liner, the vinyl assembly portion coupled to the plurality of horizontally inflatable tubes. For example, as shown in FIG. 1, vinyl assembly 140 is coupled to the plurality of horizontally inflatable tubes 150.

Step 430 provides for closing a drain assembly centrally positioned within the vinyl assembly portion near the end of a lengthwise dimension of the vinyl assembly portion. For example, as shown in FIG. 2, a drain 210 is shown centrally positioned in a width dimension and at an end of a lengthwise dimension of the vinyl assembly 140.

Step 440 provides for filling one or more of the plurality of horizontally inflatable tubes to extend a vertical dimension of the bathtub. As shown in FIG. 3, in one embodiment, horizontally inflatable tubes 310 can be filled one at a time or as in accordance with pre-defined air chambers. For example, in one embodiment, filling one or more of the plurality of horizontally inflatable tubes includes filling at least one of two or more separately fillable air chambers along a lengthwise dimension of the bathtub and a widthwise dimension of the bathtub as a function of a location of a wall. Thus, if there are four air chamber quadrants, each can be along a side of the inflatable bathtub liner, such as shown in FIG. 1 with intake/exhaust valves 110, one on each side.

In one embodiment, the filling one or more of the plurality of horizontally inflatable tubes 150 to extend a vertical dimension of the bathtub includes filling one or more of four quadrants defining the plurality of horizontally inflatable tubes, each quadrant defining a side of the bathtub, enabling each quadrant along a wall to remain unfilled. That way, if filling every horizontally inflatable tube would encroach on a bather due to the presence of a wall, a section of the horizontally inflatable tubes could remain unfilled, and the suction cups along that section be used to support the extension liner against the wall.

In one embodiment, the method further includes vertically supporting the inflatable bathtub liner via inserting a stiffened member into each of a plurality of vertical sleeves along a longitudinal dimension of the inflatable bathtub liner to provide vertical stability.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein. Furthermore, it is to be understood that the invention is defined by the appended claims.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations.

In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.).

What is claimed is:

1. An inflatable bathtub liner comprising:

a plurality of horizontally inflatable tubes adapted to be positioned around an outer perimeter of a bathtub to extend a vertical dimension of the bathtub;

a vinyl assembly coupled to the plurality of horizontally inflatable tubes, the vinyl assembly adapted to line an interior area of a bathtub; and a drain assembly, said drain assembly centrally positioned within the vinyl assembly adapted to line the interior area of the bathtub near an end of a lengthwise dimension of the vinyl assembly wherein water that is held inside the inflatable bathtub liner is released through the drain assembly and exits through a conventional bathtub drain.

2. The inflatable bathtub liner of claim 1 further comprising a plurality of horizontally spaced attachments coupled to one or more of the plurality of horizontally inflatable tubes for securing the inflatable bathtub liner to the interior area of the bathtub.

3. The inflatable bathtub liner of claim 2 wherein the plurality of horizontally spaced attachments are suction cups disposed on one or more of the plurality of horizontally inflatable tubes.

4. The inflatable bathtub liner of claim 1 wherein the plurality of horizontally inflatable tubes are organized into two or more separately fillable air chambers along each side of the inflatable bathtub liner.

5. The inflatable bathtub liner of claim 4 wherein at least one of the two or more separately fillable air chambers remain unfilled as a function of location of the bathtub liner with respect to a wall.

6. The inflatable bathtub liner of claim 1 further comprising a plurality of vertical sleeves along a longitudinal dimension of the inflatable bathtub liner, each of the plurality of vertical sleeves adapted to receive a stiffened member for providing vertical stability to the inflatable bathtub liner.

7. The inflatable bathtub liner of claim 1 wherein said plurality of horizontally inflatable tubes and said vinyl assembly are manufactured from a lightweight, flexible, vinyl product with properties that allow for ease of cleaning, puncture and tear resistance, and resistance to cleaning compounds.

8. The inflatable bathtub liner of claim 1 wherein said drain assembly is positioned in near proximity to the conventional tub drain.

9. The inflatable bathtub liner of claim 1, further comprising one or more intake/exhaust valves for inflation and deflation of the plurality of horizontally inflatable tubes.

10. The inflatable bathtub liner of claim 1 wherein the inflatable bathtub liner is comprised of between 10 and 16 gauge vinyl.

11. A method for extending a bathtub comprising:

releasably attaching a bathtub extension liner to the bathtub, the bathtub extension liner including a plurality of horizontally inflatable tubes defining an outer perimeter of a bathtub;

lining an interior area of the bathtub with a vinyl assembly portion of the bathtub extension liner, the vinyl assembly coupled to the plurality of horizontally inflatable tubes; and closing a drain assembly centrally positioned within the vinyl assembly portion near the end of a lengthwise dimension of the vinyl assembly portion; and filling one or more of the plurality of horizontally inflatable tubes to extend a vertical dimension of the bathtub.

12. The method of claim 11, wherein filling one or more of the plurality of horizontally inflatable tubes includes filling at least one of two or more separately fillable air chambers along a lengthwise dimension of the bathtub and a widthwise dimension of the bathtub as a function of a location of a wall.

13. The method of claim 12, wherein at least one of the two or more separately fillable air chambers remain unfilled as a function of location of the bathtub liner with respect to a wall.

14. The method of claim 11, wherein the filling one or more of the plurality of horizontally inflatable tubes to extend a vertical dimension of the bathtub comprises filling one or more of four quadrants defining the plurality of horizontally inflatable tubes, each quadrant defining a side of the bathtub, enabling each quadrant along a wall to remain unfilled.

15. The method of claim 11, further comprising:

filling separately fillable air chambers along each side of the inflatable bathtub liner.

16. The method of claim 11, further comprising:

vertically supporting the inflatable bathtub liner via inserting a stiffened member into each of a plurality of vertical sleeves along a longitudinal dimension of the inflatable bathtub liner to provide vertical stability.

17. The method of claim 11, wherein the inflatable bathtub liner is comprised of between 10 and 16 gauge vinyl.

18. The method of claim 11, further comprising attaching a plurality of horizontally spaced attachments to a wall outside of the bathtub.

19. The method of claim 11, further comprising attaching a plurality of horizontally spaced suction cups to a wall outside of the bathtub.

20. The method of claim 11, further comprising aligning the drain assembly with a drain of the bathtub.

* * * * *